United States Patent [19]

Ravet

[11] Patent Number: 5,033,712

[45] Date of Patent: Jul. 23, 1991

[54] CONTAINER FOR FUSIBLE MATERIALS

[75] Inventor: Serge Ravet, Roussillon, France

[73] Assignee: Rhone-Poulenc Chimie, Courbevoie, France

[21] Appl. No.: 447,416

[22] Filed: Dec. 7, 1989

[30] Foreign Application Priority Data

Dec. 7, 1988 [FR] France ..... 88 16051

[51] Int. Cl.[5] ..... B22D 29/00

[52] U.S. Cl. ..... 249/61; 164/131; 206/617

[58] Field of Search ..... 164/131; 249/61; 206/617

[56] References Cited

U.S. PATENT DOCUMENTS

| | | | |
|---|---|---|---|
| 1,896,400 | 2/1933 | Gasltine | 206/617 |
| 2,235,964 | 3/1941 | Meyer et al. | 249/61 |
| 2,583,669 | 1/1952 | Santina . | |
| 3,153,506 | 10/1964 | Pottle | 206/617 |
| 3,491,907 | 1/1970 | Eelkema | 206/617 |
| 4,804,083 | 2/1989 | Weeks | 246/61 |

FOREIGN PATENT DOCUMENTS

| | | | |
|---|---|---|---|
| 1184695 | 12/1964 | Fed. Rep. of Germany | 206/617 |
| 1465829 | 1/1967 | France . | |
| 1358971 | 7/1974 | United Kingdom . | |

OTHER PUBLICATIONS

Article: "Gallium as a By-Product of Alumina Manufacture" by L. K. Hudson, Journal of Metals, Sep. 1965 (pp. 948-951.

*Primary Examiner*—Kuang Y. Lin

*Attorney, Agent, or Firm*—Burns, Doane, Swecker and Mathis

[57] ABSTRACT

The present invention concerns a container for a fusible material such as gallium. The material is introduced to the container in liquid form and solidifies therein. The body contains two intersecting tear strips making it possible to easily strip the block of solidified material from the container. Each of the tear strips extends past its point of intersection with the other tear strip to maximize the extent to which the container is opened up. The material can thus be removed from the container with minimal handling and risk of being contaminated.

10 Claims, 1 Drawing Sheet

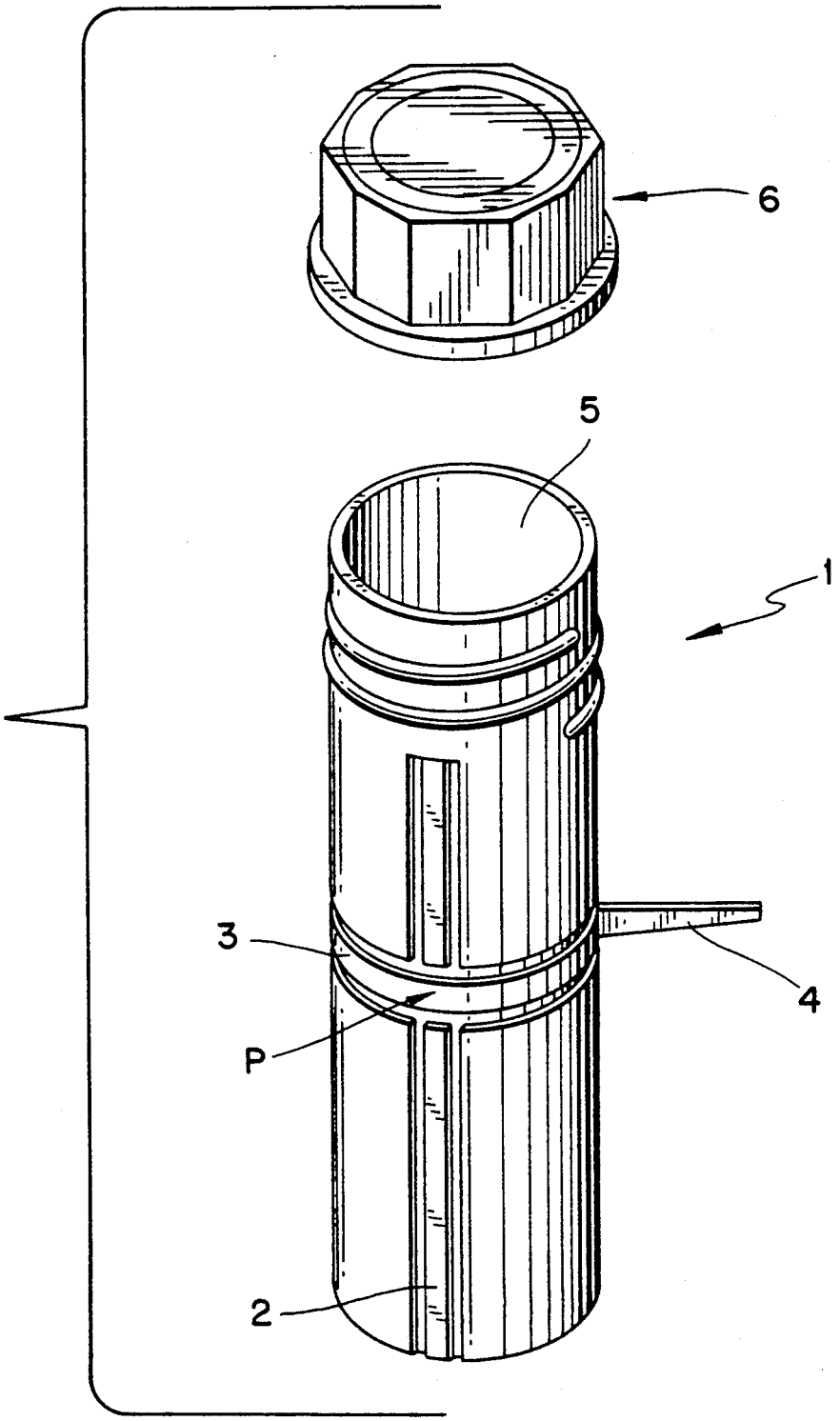
6
5
1
3
4
P
2

CONTAINER FOR FUSIBLE MATERIALS

BACKGROUND OF THE INVENTION

1. Field of the Invention

The present invention relates to an improved container for solidified material, and, more especially, to an improved container for fusible material that must be filled with such material while it is in the liquid state, with the material being transformed into solid state upon storage thereof.

2. Description of the Prior Art

In order to store or handle certain solid materials at ambient temperature, they must be introduced in the liquid form into appropriate container or receptacle. The material solidifies in the container.

To recover such material, it is necessary to reliquefy it to be able to extract or remove it from the container, or to destroy the container to recover the solid mass container therein.

Heretofore, and in particular in the field of high purity materials used for specific applications where no impurities may be introduced, such as the use of gallium in the electronics industry, the material is recovered by melting it or by destroying the packaging for the ingot that has become solidified therein.

This stage of melting or destruction of the packaging entails numerous disadvantageous and considerably increases the risk of contaminating the material, in particular if the material is of very high purity, such as gallium (99.999999% pure).

For such a material, the destruction of the container or the packaging by simple fracture is not feasible, as the risk of pollution is further increased, particularly if there is any contact with the tools used to destroy the container and the material contained therein.

SUMMARY OF THE INVENTION

Accordingly, a major object of the present invention is the provision of an improved container or receptacle which can be filled by material in the liquid state and thereafter solidified therein, said improved container conspicuously avoiding those disadvantages and drawbacks to date characterizing the state of this art and including means for the removal of such solidified material therefrom without risking its pollution or requiring a melting thereof.

Briefly, the present invention features a container for solidified materials which is filled by pouring therein such material while it is in the liquid state, said container comprising a housing provided with an opening for filling it, means for sealing the filled container, and also means for providing at least one second opening to permit stripping of the solidified material therefrom.

The present invention thus provides an improved container that can be emptied of the solidified contents thereof without requiring that such contents be heated to melting, or without having to use tools for the physical destruction of the container.

BRIEF DESCRIPTION OF THE DRAWING

The sole Figure of Drawing is a perspective exploded view of a container according to the invention.

DETAILED DESCRIPTION OF THE PREFERRED EMBODIMENTS OF THE INVENTION

More particularly according to the present invention, in a preferred embodiment thereof, the means to form the at least one second opening, designated the stripping opening, include at least one tear strip formed on the wall member of the body of the container.

This tear strip may be of any shape or length. It is sufficient that the opening created by the tearing of said strip be adequate for the ready stripping of the solidified material from the container.

Thus, and only as one example, the tear strip may be formed over at least a portion of the length of a generatrix of the housing body of the container and/or at least over a portion of the circumference of the section of said container.

In another preferred embodiment of the invention, the container comprises at least two intersecting tear strips, one being formed over at least a portion of a generatrix of the housing body of the container, and the other over at least a portion of the circumference of the section of said container.

In still another preferred embodiment of the invention, the container comprises means to tear off the tear strip or strips. These means are advantageously a tongue or tab integral with a tear strip.

Thus, by simply pulling on the tongue, the tear strip or strips are removed to form an opening making possible the stripping and recovery of the material without having to handle it and without contacting it with another element which may pollute it.

Another advantage of the container of the invention resides in the fact that it is possible to introduce a predetermined amount of liquefied material into it, as a function of its intended end application.

The user therefore has available the desired weight of the material and does not have to handle it, thereby again reducing the risk of pollution.

Furthermore, the container may have any particular shape, such as that of a preferably slightly conical cylinder, of a bottle, or any other desired form or configuration. The opening created by the tearing of the strip permits the easy stripping of the material and the form and dimensions of the tear strip are determined as a function of the form of the container and the opening necessary to provide easy stripping.

The container of the invention is advantageously airtight to prevent any pollution of the material contained therein. However, such tightness is necessary for specific applications only, in particular for the storage of materials sensitive to humidity or oxygen, for example.

In a preferred embodiment of the invention, the container is fabricated from a synthetic plastic material, such as, for example, polyethylene. It may be produced by any known process, such as molding, extrusion, injection molding, and the like.

The container of the invention is used, for example, for the storage and/or molding of a material which is solid at ambient temperature or at its storage temperature, and having a melting temperature compatible with the material used to manufacture the container.

Containers manufactured of a synthetic plastic material are therefore used to store materials having a low melting point, such as gallium, mercury, and the like.

It is also possible to use containers manufactured from another material, such as a metal (aluminum, iron, etc.). In this case, the material stored may have a higher melting point.

The containers of the invention may also be used as molds to shape solid articles into a predetermined configuration and/or as packaging containers for the materials.

Such container according to the invention comprises a body member or housing 1 which could be cylindrical or slightly conical. The body may be made of polyethylene or any other material. It includes two tear strips 2 and 3 formed via reduction of the wall thickness of the body member 1. Therefore, by pulling on a tongue 4 secured to the tear strips, for example made of the same material, the strips 2 and 3 are easily torn, thereby creating an opening which permits the easy removal of the block of solidified material contained in the container.

The container further comprises an inlet opening 5 for pouring the liquid material into and thus filling the container.

After filling, the opening is closed, and preferably hermetically sealed, by a threaded plug 6.

It is also within the scope of the invention to employ different sealing means to close the opening, for example using capsules of synthetic materials or other materials plugged into or adhesively bonded to the opening 5.

In the depicted embodiment the tear strips 2 and 3 intersect, with the strip 2 being formed longitudinally on a generatrix of the body of the container, and with the strip 3 being formed on the circumference of the section of said body 1. The strips 2 and 3 may extend entirely or only partly along the respective longitudinal and circumferential dimensions of the body. The tear strips 2, 3 can be arranged to be removed together during a pull against the tongue 4, or the tear strip 2 can be severed by the removal of the tear strip 3 and removed separately thereafter. The tear strips 2, 3 intersect one another at a point of intersection P situated intermediate the ends of both tear strips. Thus, the tear strip 2 extends in opposite longitudinal directions from the point P, and the tear strip 3 extends in opposite circumferential directions from the point P.

The disposition, number and dimensions of such tear strips may be arbitrary and are adapted to the form of the container 1 and the opening desired for the easy removal of the solidified block of material.

The invention is equally applicable to any form of the container and, in particular, to containers in the shape of a bottle.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A container for receiving material which is introduced in a liquid state and thereafter converts to a solid state within the container, said container comprising a body enclosure including a first opening for introducing such liquid material, and means for closing said inlet opening, said body enclosure including opening-forming means for creating a second opening therein for enabling the solidified material to be removed from the container, said opening-forming means comprising tear strip means including first and second tear strips, said first tear strip extending generally longitudinally for at least a portion of a longitudinal length of said body enclosure, said second tear strip extending generally circumferentially for at least a portion of a circumference of said body enclosure, said first and second tear strips intersecting one another at a point of intersection, said first tear strip extending in opposite, generally longitudinal directions from said point of intersection, and said second tear strip extending in opposite, generally circumferential directions from said point of intersection.

2. A container according to claim 1 including a manually grippable tongue connected to said tear strip means.

3. A container according to claim 1, wherein said tear strips are defined by reduced-thickness regions of said body enclosure which intersect one another.

4. A container as defined by claim 1, wherein said body is cylindrical.

5. A container as defined by claim 1, wherein said body is slightly conical.

6. A container as defined by claim 1, wherein said body enclosure comprises a bottle.

7. A container as defined by claim 1, wherein said body enclosure is formed of a synthetic material.

8. A container as defined by claim 7, wherein said body enclosure is formed of polyethylene.

9. A container as defined by claim 1, wherein said means for closing said first opening comprises a plug securable to said body enclosure.

10. A container as defined by claim 1, wherein said means for closing said first opening creates an air tight seal.

* * * * *